US007597136B2

(12) United States Patent
Kite et al.

(10) Patent No.: US 7,597,136 B2
(45) Date of Patent: Oct. 6, 2009

(54) HEAT EXCHANGER WITH HELICAL FLOW PATHS

(75) Inventors: Murray James Kite, Napier (NZ); Rodney Mitchell Innes, Cromandel (NZ)

(73) Assignee: Energy Saving Concepts Limited, Napier (NZ)

( * ) Notice: Subject to any disclaimer, the term of this patent is extended or adjusted under 35 U.S.C. 154(b) by 371 days.

(21) Appl. No.: 10/543,369

(22) PCT Filed: Jan. 29, 2004

(86) PCT No.: PCT/NZ2004/000008

§ 371 (c)(1),
(2), (4) Date: Jul. 26, 2005

(87) PCT Pub. No.: WO2004/068054

PCT Pub. Date: Aug. 12, 2004

(65) Prior Publication Data

US 2006/0124285 A1 Jun. 15, 2006

(30) Foreign Application Priority Data

Jan. 31, 2003 (NZ) ..... 523962

(51) Int. Cl.
*F28F 7/10* (2006.01)
*F28D 7/12* (2006.01)
*F28F 1/14* (2006.01)
*F28F 1/36* (2006.01)

(52) U.S. Cl. ..... 165/156; 165/154; 165/184

(58) Field of Classification Search ..... 165/154, 165/184, 156

See application file for complete search history.

(56) References Cited

U.S. PATENT DOCUMENTS 1,740,300 A * 12/1929 Henszey ..... 122/379

(Continued)

FOREIGN PATENT DOCUMENTS

WO WO 99/67584 12/1999

OTHER PUBLICATIONS

Derwent Abstract Accession No. 88-320822/45; SU 1390511 A; (Moscow Bauman Tech Coll); Apr. 23, 1988.

(Continued)

*Primary Examiner*—Cheryl J Tyler
*Assistant Examiner*—Brandon M Rosati
(74) *Attorney, Agent, or Firm*—Henricks, Slavin & Holmes LLP

(57) ABSTRACT

A heat exchanger includes a body 4 on the surface of which are provided helical or spiral paths 5 which will provide multiple and turbulent flow paths A for a first fluid such as water which is caused to flow through chamber 3 relative to a spirally wound heat exchange tube 6 and in a heat transfer relationship with a second fluid flowing through the tube 6. The tube 6 has one or more further helical or spiral flow paths 9 on its external surface. The multiple flow paths A will extend the residence time for the first fluid within the heat exchanger 1 and this together with the turbulence will maximise heat transfer. Preferably a portion of the first fluid flow will be through a central aperture in body 4 where turbulence is also created by the helical or spiral paths of the tube 6 as it extends through the aperture.

22 Claims, 5 Drawing Sheets

U.S. PATENT DOCUMENTS 1,776,135 A * 9/1930 Smith ..... 122/476
2,462,012 A * 2/1949 Vilter ..... 62/470
3,802,499 A * 4/1974 Garcea ..... 165/163
4,065,264 A * 12/1977 Lewin ..... 422/46
4,232,735 A * 11/1980 Kim et al. ..... 165/183
4,317,268 A * 3/1982 Bowden et al. ..... 29/890.033
4,895,203 A * 1/1990 McLaren ..... 165/41
5,487,423 A * 1/1996 Romero ..... 165/156
6,102,561 A * 8/2000 King ..... 366/181.5
6,293,335 B1 9/2001 Tawney et al.
6,499,534 B1 12/2002 Tawney et al.
7,261,149 B2 * 8/2007 Nail ..... 165/163
2002/0040587 A1 * 4/2002 Flynn ..... 62/430

OTHER PUBLICATIONS

Derwent Abstract Accession No. 95-262495/34; RU 2027969 C1; (Tark Res Prodn Enterp); Jan. 27, 1995.

* cited by examiner

HEAT EXCHANGER WITH HELICAL FLOW PATHS

CROSS REFERENCE TO RELATED APPLICATIONS

This application is a National Stage of International Application No. PCT/NZ2004/000008, filed Jan. 29, 2004.

TECHNICAL FIELD

The present invention relates to improvements in and relating to heat exchangers.

BACKGROUND

In our New Zealand Patent Specification No. 508895 (also WO 99/67584) there is described a heat exchanger tracking including a spiral heat exchanger with coils and the track between the coils providing a second flow path which improves the efficiency of the heat exchange.

In the design of heat exchangers it is important to ensure that the fluid being heated or cooled stays in the heat exchanger for an optimum time. Another design criteria is to obtain a low pressure drop through the heat exchanger and optimise the heat exchange taking place within the heat exchanger.

OBJECTS OF THE INVENTION

It is thus an object of the present invention to provide a heat exchanger and/or a method of providing heat exchange which will provide for an effective heat exchange and/or will at least provide the public with a useful choice. Further objects of the invention may become apparent from the following description.

SUMMARY OF THE INVENTION

According to one aspect of the present invention, there is provided a heat exchanger including a body and at least one first substantially spiral or helical flow path provided for an external surface thereof, the body positioned within a housing to define a chamber between said external surface and an internal wall of said housing, a tube assembly helically or spirally positioned about said external surface, said tube assembly having at least one second substantially helical or spiral flow path provided for its external surface, the relationship between the said at least first and said at least second helical or spiral flow paths being such that a first fluid flowing through said chamber is caused to flow along multiple turbulent flow paths, in heat transfer relationship with a second fluid flowing through said tube assembly.

Preferably the body as defined in the paragraph immediately above is substantially cylindrical and said at least first substantially spiral or helical flow path extends along a longitudinal axis of said body.

Preferably said at least first spiral or helical flow path directs, in use, at least a portion of said first fluid flowing therein so that it impacts with a portion of said first fluid flowing in said at least one second flow path to create said turbulence.

According to a further aspect of the present invention a heat exchanger is substantially as herein described with reference to any one of the embodiments of the invention as described and/or as shown in the accompanying drawings.

According to a still further aspect of the present invention a method of providing fluid flow control for a heat exchanger is substantially as herein described with reference to any one of the embodiments of the invention as described and/or as shown in the accompanying drawings.

Further aspects of this invention which should be considered in all its novel aspects will become apparent from the following description given by way of example of possible embodiments thereof.

BRIEF DESCRIPTION OF POSSIBLE EMBODIMENTS OF THE INVENTION

The present invention will now be described in respect of one particular form of heat exchanger and for simplicity will relate to a particular form of heat exchanger in which a particular fluid, water, is required to be cooled by its controlled flow past the heat exchange tubes in which a refrigerant is provided. It will be appreciated by those skilled in heat exchange technology however that this is only by way of example and that the present invention could find application where ever a first fluid is to be either heated or cooled and accordingly in which the heat exchange coils would be containing a second fluid which would be transferring heat to or from the first fluid so as to provide the required heating or cooling action. The first and second fluids may in some instances be the same.

Figure 1:
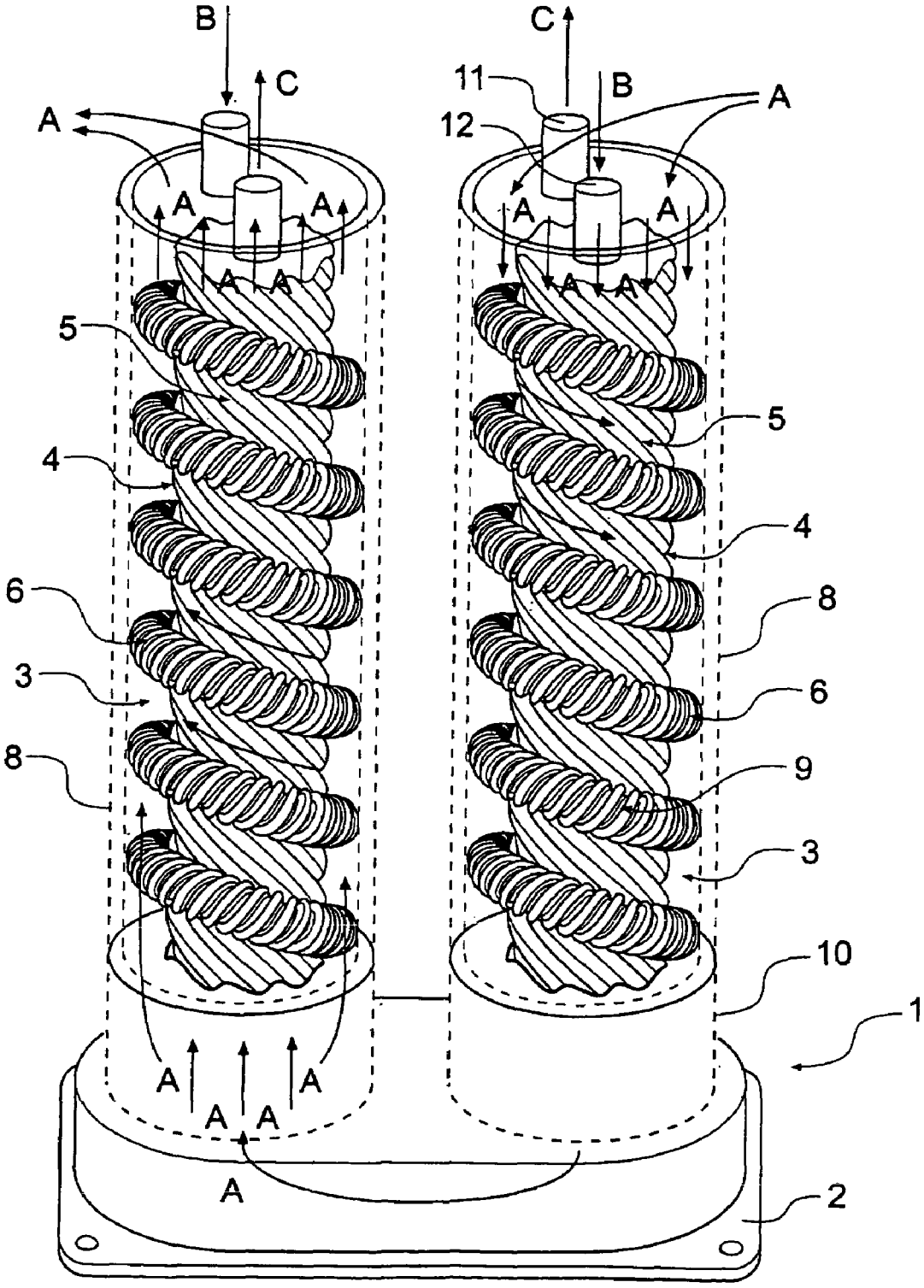
FIG. 1: Shows very diagrammatically a possible embodiment of a heat exchanger assembly in which the fluid being heated or cooled flows in series through a plurality (two being shown) of heat exchange columns.

Subject to the above provisos, it is seen that in FIG. 1 a heat exchanger referenced generally by arrow 1 includes by way of example only a mounting base 2 on which, in this example, two heat exchange housings 8 are provided extending upwardly therefrom. Water in this example is caused to flow in a direction indicated by arrows A in series through the heat exchange housings 8 as it is cooled by the refrigerant flowing through the heat exchange coils 6 which may be in a direction indicated by arrows B and C, although alternative directions may be chosen for either housing. Also the tubes 6 in the respective columns could be connected together to provide a common fluid circuit. That would normally be a top connection.

The heat exchange coils 6 are tightly wrapped in a spiral or helical path having a tread direction around an elongate support body or mandrel 4. The coils 6 have one or more (only one being shown) spiral or helical, ribs, corrugations, protrusions, intrusions, tracks, or the like 9 having a tread direction. The body 4 has an external surface with spiral or helical, ribs, corrugations, protrusions, intrusions, tracks, or the like 5 having a tread direction defining a plurality of fluid paths along the length of the body 4, any of these alternatives being included whenever the term "fluid paths" is used hereinafter.

External smooth portions 11 and 12, of the coils 6 can provide the connection for an inlet and/or outlet for the refrigerant or heating fluid flowing in the direction of arrows B and C in the example shown.

It is seen that multiple complex flow paths A exist in each housing 8 with the water flowing between the tube 6 and the body 4, both in the longitudinal spacing therebetween and in gaps left as they abut. Also water flow is between the tube 6 and the housing 8. This is further described with reference to FIGS. 4 and 5 particularly.

Figure 2:
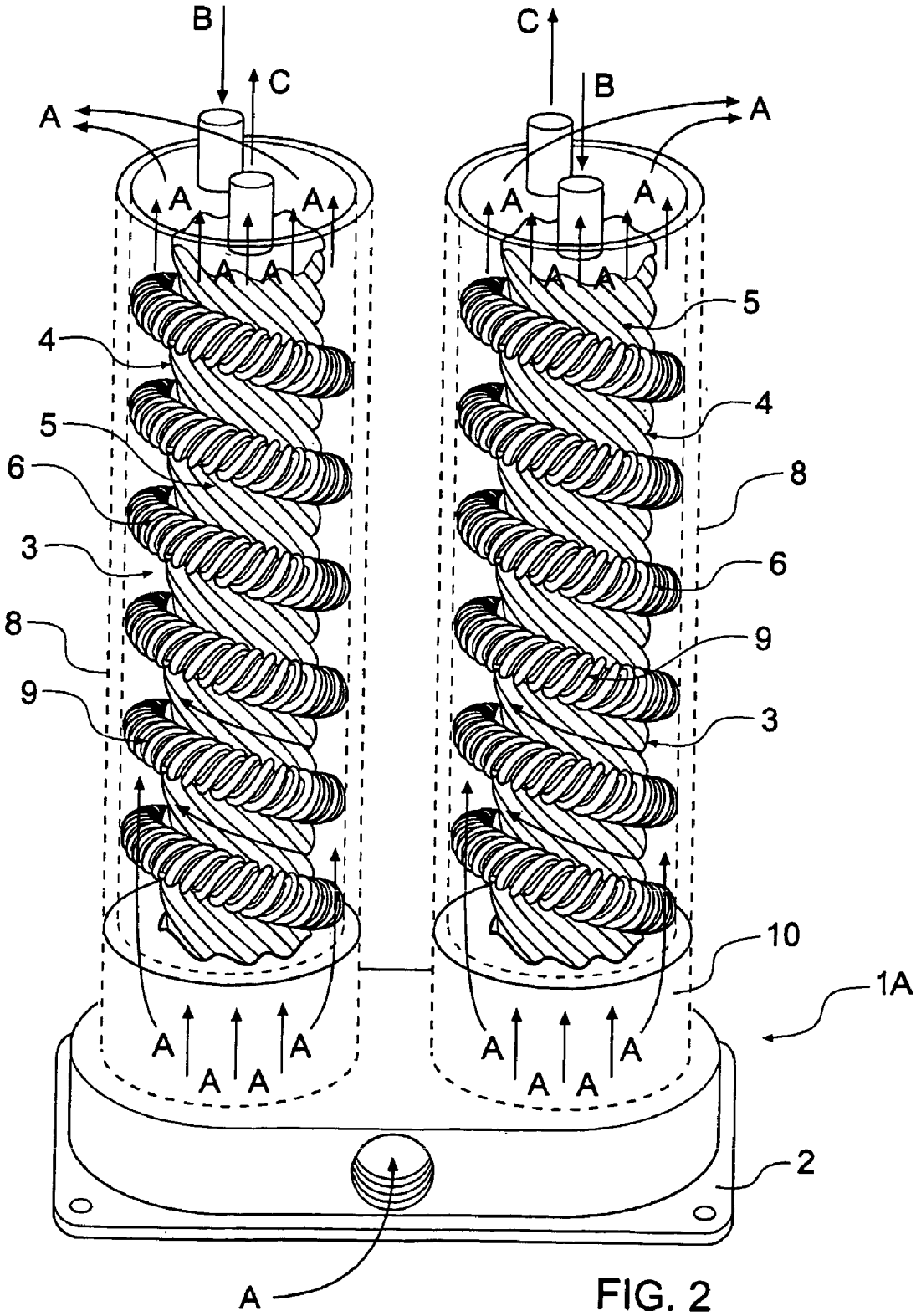
FIG. 2: Shows very diagrammatically a similar arrangement to that of FIG. 1 in which the fluid flow is parallel.

In contrast, in FIG. 2 the flow of water in the direction of arrows A is seen to be in parallel through the pair of heat exchange housings 8 in heat exchanger 1A.

As with the embodiment of FIG. 1, in FIG. 2 the disposition of the helical or spiral paths 9 on the surface of the spirally or helically wound tube 6, relative to the helical or spiral paths on the body 4, result in a plurality of turbulent flow paths A for the water or other fluid flowing through the two housings 8.

It will be appreciated that any number of heat exchange housing assemblies 8, not necessarily two as shown, could be provided. In the exchangers 1, 1A of FIGS. 1 and 2 each body 4 is shown located in an upstanding portion 10 of the base 2. Each body 4 is, however, suitably supported by means of the respective tube ends 11, 12 which are securely fastened with a top assembly (see FIG. 3) by means of tensioning nuts or the like. The flow of the refrigerant or heating fluid through the tubes 6 may be in the same or opposite direction to that of the water or other fluid being cooled or heated as it passes through the housings 8 although by way of example the fluid is shown flowing in the directions B, C in the figures. Typically, for a heat exchanger capacity of 400 liters/minute the water or other fluid may be under a pressure of perhaps 10 psi, and a suitable pump will be provided for that purpose. The body 4 may be of any suitable material. However, a moulding of polyethylene or other plastic material may be appropriate. The tubes 6 may suitably be of metal, titanium being a preferred option.

Figure 3:
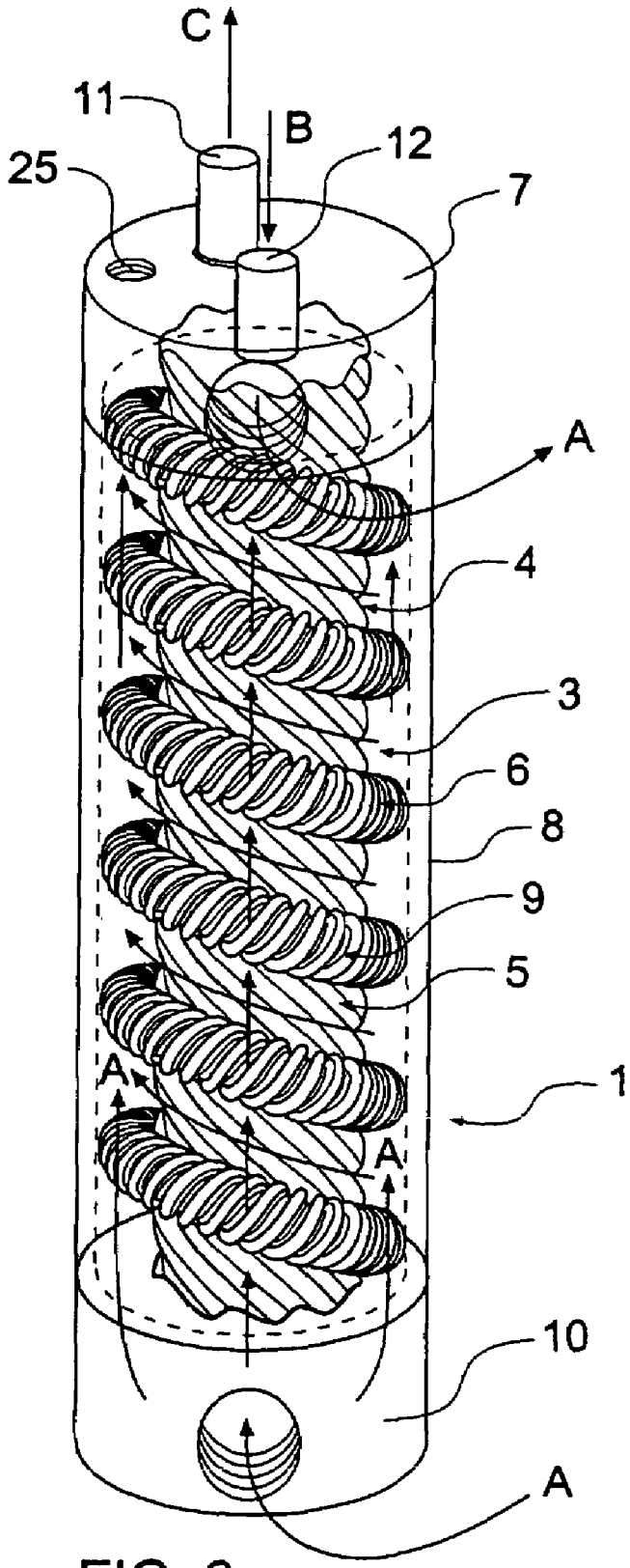
FIG. 3: Shows very diagrammatically a possible embodiment of a heat exchanger assembly with a single heat exchange column.

Referring to FIG. 3 a single heat exchange housing 8 is shown in some greater detail. The flow of the water or other fluid in the direction of arrows A is shown being both longitudinally and transverse of the body 4 and the tube 6 and within the chamber 3. Also a proportion of the water flow is centrally through the aperture through the body 4.

It is mentioned that in all the above examples any suitable refrigerant could be used e.g. a liquid, such as water or glycol, or a suitable gas or the like.

The housing or casing 8 in all the above FIGS. 1 to 3 may be of any suitable material such as a hard plastics such as polyethylene or nylon, or a metal such as stainless steel.

The heat exchange assembly 1 of FIG. 3 is also shown provided with a possible top assembly 7 which could be suitably secured to the top end of the housing 8 such as by gluing, welding, bolting, screwing or the like. A lateral water outlet is shown provided for the top 7 for the flow of water A. A nut assembly or the like including O-rings may be provided to secure the top ends 11, 12 of the refrigerant tube 6 in position extending through the top 7 and through the appropriate apertures provided for that purpose. As the tube 6 is tightly wound about the body 4 and its bottom end extends beneath the bottom of the body 4, the body 4 and the tube 6 will be thereby supported. A thermostat holder or recess 25 is also shown provided for top 7.

In all the above examples of possible heat exchange assemblies, heat exchange efficiency is improved by extending the residence time of the water and particularly by the water flow being provided with a turbulence which will improve heat transfer to the refrigerant through the refrigerant tubes.

The improved heat transfer efficiency is such that in a typical 33 KW shell and tube heat exchanger the present invention may only require approximately 10 meters of titanium tube 6 compared with the over 20 meters which other designs would typically require. This means that a heat exchanger according to the present invention may be substantially smaller and less expensive than previously available units.

Figure 4:
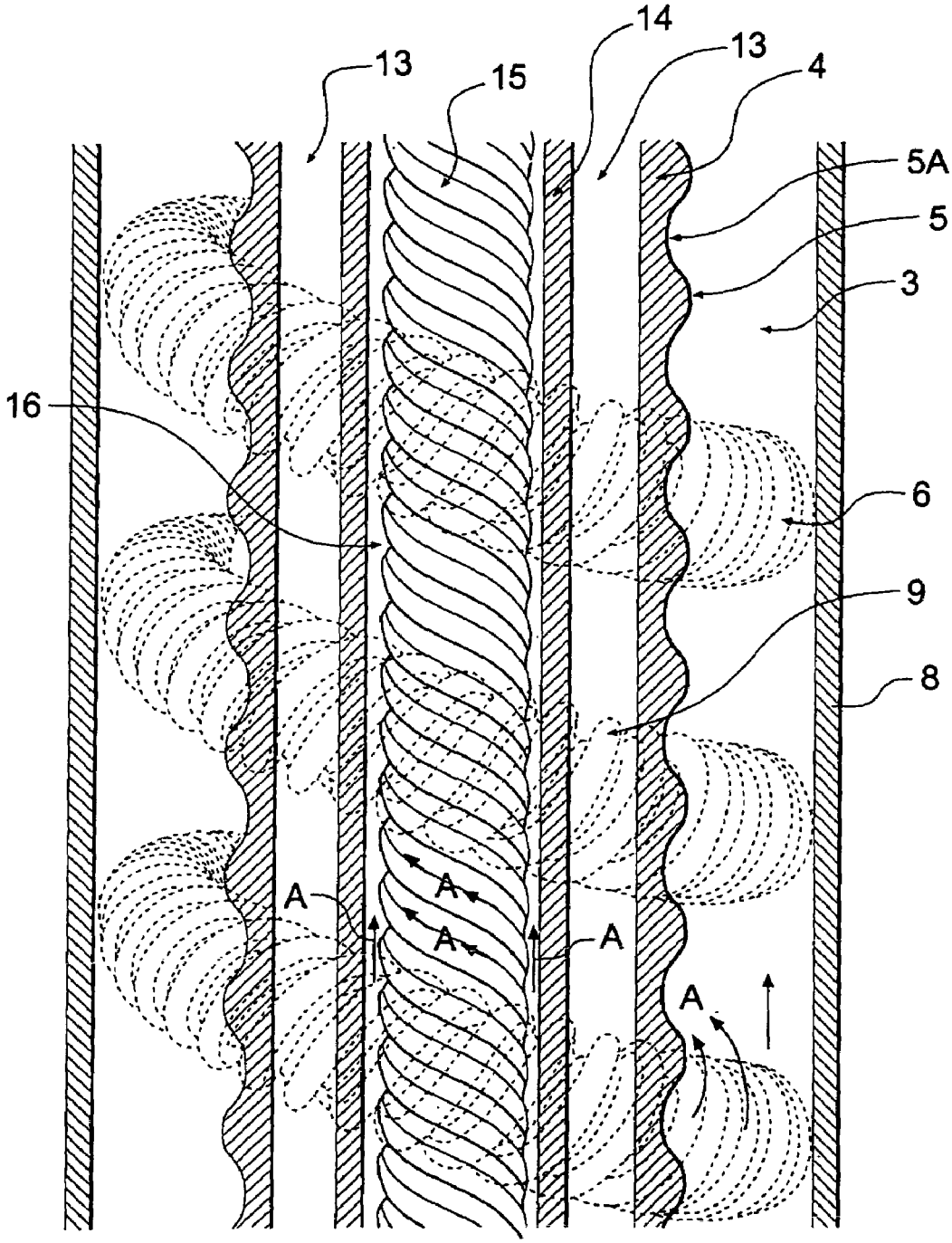
FIG. 4: Shows very diagrammatically an enlarged cross sectional view of part of the heat exchanger assembly of FIG. 3.
Figure 5:
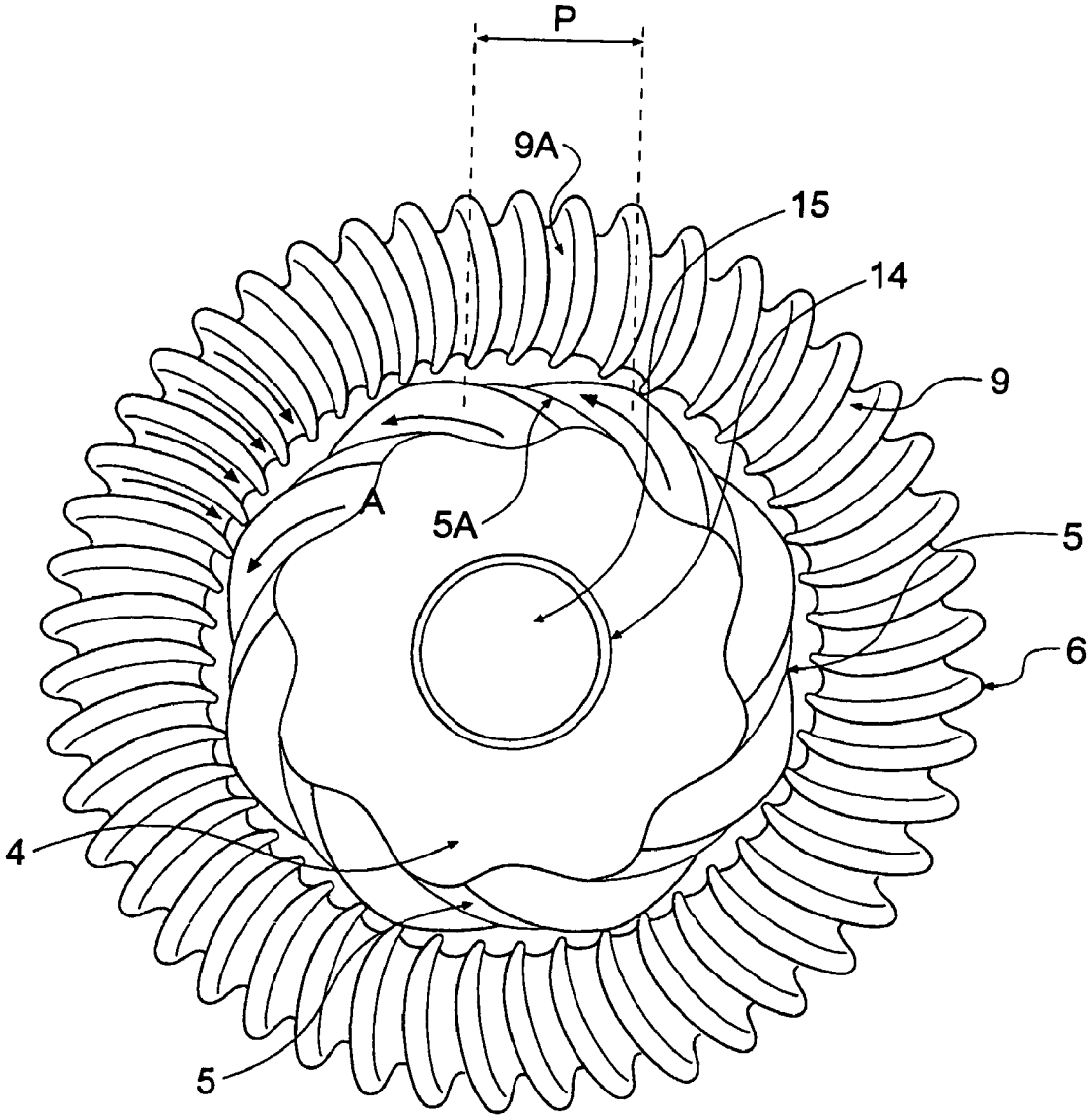
FIG. 5: Shows very diagrammatically an enlarged end view of the heat exchanger assembly of FIG. 3.

Referring now to FIGS. 4 and 5 cross sectional and end views of the exchanger 1 of FIG. 3 are shown enlarged and in greater detail.

It is seen that the helical or spiral flow paths 5 on the surface of body 4 define with the outer helical or spiral surface of the refrigerant tube 6 multiple and complex flow paths A for the water which will both extend the residence time for the water within the assembly 1 so as to maximise heat transfer but will also provide a turbulence in the water flow which will again enhance the heat transfer, the turbulence being created as the water impacts on the tube 6 and body 4 and as it changes direction. As is seen especially from FIG. 5, as the tube 6 passes around the body 4 it may abut it in places or leave gaps so that water is forced between and around the body 4 and tube 6 and will become turbulent and will also separate into numerous flow paths as shown. The pitch of the flow paths 9 on the outer surface layer of the refrigerant tube 6 and/or the gaps between the refrigerant tube 6 and the outer casing 8 and/or the flow paths 5 may be such as to enhance turbulence and/or the control of pressure drop through the heat exchanger 1. It is mentioned in the latter regard that a low pressure drop through a heat exchanger is desirable in order to achieve required pump size and energy requirements.

It is also seen in FIG. 4 that a gap 16 is present between the vertical return 15 of the refrigerant tube 6 and the central aperture or tube 14 of the body 4. The passage of water through the gap 16 and around the helical or spiral track of the return 15 will also create turbulence. It is envisaged that a reasonable proportion of the water may be caused to flow through the central aperture 14 rather than through the chamber 3. It is also seen that in FIG. 4 the body 4 has been rotationally moulded so as to provide a hollow central portion 13. Alternatively the body 4 could be moulded or cast for example as a solid body, apart from the central aperture 14.

Referring particularly to FIG. 5, it is seen how the body 4 may be provided with multiple spiral or helical flow paths or tracks 5 which can be in or out of phase with the positioning of the flow paths or tracks 9 on the tube 6, wrapped around the body 4.

Within the distance P it is seen that the tube 6 may include three tracks 9A whereas the body 4 has only one track 5A. Suitably the pitch of the helix or spiral on the tube 6 may be at least twice the length of that of the body 4. The water flowing around the flow paths 9A of tube 6 will therefore be impacting three times on the water flowing in the flow path 5A of the body 4. These impacts will be, in the example shown, at an angle, resulting in substantial turbulence being created. FIG. 5 also illustrates that the tube 6 is tightly wound on the body 4. Suitably the coiled tube 6 may have the body 4 inserted into it so that the tube 6 springs back into position about the body 4. This tight wrapping of the tube 6 will assist in preventing the vibration of the tube 6 and also it trying to unwind itself as the pressurised refrigerant or other fluid flows through it. The tube 6 is also provided so as to be a close fit against the housing 8, again preventing vibrations and possible unwinding.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope or spirit of the invention as defined in the appended claims.

The invention claimed is:

1. A heat exchanger including a body and at least one first substantially spiral or helical flow path having a first thread direction and provided on an external surface thereof, the body positioned within a housing to define a chamber between said external surface and an internal wall of said housing, a tube assembly helically or spirally positioned with the first thread direction about said external surface, said tube assembly having at least one second substantially helical or spiral flow path with the first thread direction and provided on its external surface and wherein the at least second substantially helical or spiral flow path extends from closely adjacent the external surface of the body to closely adjacent the internal wall of the housing, the relationship between the said at least first and said at least second helical or spiral flow paths being such that a first fluid flowing through said chamber is caused to flow along multiple turbulent flow paths, in heat transfer relationship with a second fluid flowing through said tube assembly.

2. A heat exchanger as claimed in claim 1 wherein said body is cylindrical and said at least one first substantially spiral or helical flow path extends along the longitudinal axis of said body.

3. A heat exchanger as claimed in claim 2 in which said at least first spiral or helical flow path directs, in use, at least a portion of said first fluid flowing therein so that it impacts a portion of said first fluid flowing in said at least one second flow path.

4. A heat exchanger as claimed in claim 3 wherein the body is cast or moulded with a plurality of said spiral or helical flow paths.

5. A heat exchanger as claimed in claim 4 wherein said body is moulded from a plastics material.

6. A heat exchanger as claimed in claim 1 in which said body includes a substantially central aperture through which a portion of said tube assembly extends.

7. A heat exchanger as claimed in claim 6 wherein a gap between said external surface of said tube assembly and an internal wall of said central aperture allows for said first fluid to flow through said central aperture in said gap, with the at least second helical or spiral flow path producing turbulence in said fluid as it flows through said central aperture.

8. A heat exchanger as claimed in claim 1 in which a first pitch of said helical or spiral flow path of said tube assembly and a second pitch of the helical or spiral flow path of the body are such as to substantially enhance turbulence in said fluid passing therebetween and thereover.

9. A heat exchanger as claimed in claim 8 in which said second pitch is at least twice the length of said first pitch.

10. A heat exchanger as claimed in claim 1 and including at least a pair of said housings and in which said first fluid is caused to flow through said housings in series.

11. A heat exchanger as claimed in claim 1 and including at least a pair of said housings and in which said first fluid is caused to flow through said housings substantially in parallel.

12. A heat exchanger as claimed in claim 1 in which said at least first spiral or helical flow path directs, in use, at least a portion of said first fluid flowing therein so that it impacts a portion of said first fluid flowing in said at least one second flow path.

13. A heat exchanger as claimed in claim 12 wherein the body is cast or moulded with a plurality of said spiral or helical flow paths.

14. A heat exchanger as claimed in claim 13 wherein said body is moulded from a plastics material.

15. A heat exchanger as claimed in claim 12 in which said body includes a substantially central aperture through which a portion of said tube assembly extends.

16. A heat exchanger as claimed in claim 15 wherein a gap between said external surface of said tube assembly and an internal wall of said central aperture allows for said first fluid to flow through said central aperture in said gap, with the at least second helical or spiral flow path producing turbulence in said fluid as it flows through said central aperture.

17. A heat exchanger as claimed in claim 12 in which a first pitch of said helical or spiral flow path of said tube assembly and a second pitch of the helical or spiral flow path of the body are such as to substantially enhance turbulence in said fluid passing therebetween and thereover.

18. A heat exchanger as claimed in claim 17 in which said second pitch is at least twice the length of said first pitch.

19. A heat exchanger as claimed in claim 12 and including at least a pair of said housings and in which said first fluid is caused to flow through said housings in series.

20. A heat exchanger as claimed in claim 12 and including at least a pair of said housings and in which said first fluid is caused to flow through said housings substantially in parallel.

21. A heat exchanger as claimed in claim 1 wherein the body flow path extends in a first direction from a first side of the body to a second side of the body, wherein the tube is helically or spirally positioned about the external surface of the body in a second direction from the first side of the body to the second side of the body, and wherein the external flow path on the tube assembly extends in a third direction different from the first direction of the first flow path from the second side of the body to the first side of the body.

22. A heat exchanger as claimed in claim 20 wherein the first and second directions are different from each other.

* * * * *